US009539637B2

(12) United States Patent
McGuire et al.

(10) Patent No.: US 9,539,637 B2
(45) Date of Patent: Jan. 10, 2017

(54) INVESTMENT CASTING REFRACTORY MATERIAL

(71) Applicant: WiSys Technology Foundation, Inc., Madison, WI (US)

(72) Inventors: Daniel Scott McGuire, Oregon, WI (US); Eric Ernst Hellstrom, Tallahassee, FL (US)

(73) Assignee: WISYS TECHNOLOGY FOUNDATION, INC., Madison, WI (US)

( * ) Notice: Subject to any disclaimer, the term of this patent is extended or adjusted under 35 U.S.C. 154(b) by 0 days.

(21) Appl. No.: 13/735,770

(22) Filed: Jan. 7, 2013

(65) Prior Publication Data

US 2014/0190647 A1 Jul. 10, 2014

Related U.S. Application Data

(60) Provisional application No. 61/584,056, filed on Jan. 6, 2012.

(51) Int. Cl.

| | |
|---|---|
| ***B22C 1/02*** | (2006.01) |
| ***B22C 1/14*** | (2006.01) |
| ***B22C 9/04*** | (2006.01) |

(52) U.S. Cl.
CPC .. *B22C 1/02* (2013.01); *B22C 9/04* (2013.01)

(58) Field of Classification Search
CPC ..... B22C 1/02; B22C 1/14; B22C 9/04
USPC ..... 164/516, 519, 361; 106/38.27
See application file for complete search history.

(56) References Cited

U.S. PATENT DOCUMENTS

| | | | | |
|---|---|---|---|---|
| 3,165,799 | A | | 1/1965 | Watts |
| 3,352,814 | A | * | 11/1967 | Collins, Jr. et al. ..... 523/307 |
| 4,019,559 | A | | 4/1977 | Szabo |
| 4,026,344 | A | | 5/1977 | Greskovich |
| 4,432,798 | A | | 2/1984 | Helferich et al. |
| 4,581,068 | A | | 4/1986 | Schramm |
| 4,689,081 | A | | 8/1987 | Watts |
| 5,147,830 | A | | 9/1992 | Banerjee et al. |
| 5,391,606 | A | | 2/1995 | Doles |
| 6,013,125 | A | | 1/2000 | Quraishi et al. |
| 6,375,692 | B1 | | 4/2002 | Manwiller et al. |
| 6,551,396 | B1 | | 4/2003 | Pineda et al. |
| 6,814,131 | B2 | | 11/2004 | Vandermeer |
| 7,278,465 | B1 | | 10/2007 | McGuire et al. |
| 2006/0081350 | A1 | | 4/2006 | Batlo et al. |
| 2011/0232857 | A1 | | 9/2011 | McGuire et al. |

FOREIGN PATENT DOCUMENTS

| | | |
|---|---|---|
| SU | 1419788 | 8/1988 |

* cited by examiner

*Primary Examiner* — Kevin P Kerns
(74) *Attorney, Agent, or Firm* — Boyle Fredrickson, S.C.

(57) ABSTRACT

An investment casting method involves producing a casting shell by applying a hardenable refractory material to a sacrificial pattern. The casting shell having a plurality of phosphate bonds in the hardenable refractory material, which provide increased structural integrity during casting and improved frangibility during shell removal. The casting shell may also have a plurality of gaseous pockets suspended in the refractory material, which do not degrade the structural integrity during casting and provide improved frangibility during shell removal.

20 Claims, No Drawings

INVESTMENT CASTING REFRACTORY MATERIAL

STATEMENT REGARDING FEDERALLY SPONSORED RESEARCH OR DEVELOPMENT

CROSS REFERENCE TO RELATED APPLICATION

This case claims the benefit of provisional application 61/584,056 filed Jan. 6, 2012 and provisional application 61/711,994 filed Oct. 10, 1012, both of which are hereby incorporated by reference.

BACKGROUND OF THE INVENTION

The present invention relates to a refractory material and in particular refractory material suitable for investment casting as well as non-foundry applications.

Investment casting is commonly used to produce high-quality cast products. Generally, an investment casting of a part is made by coating a pattern with a material that hardens to create a unitary, thin-walled, heat-resistant shell. The internal pattern may be constructed of either a low melting point substrate or a combustible substrate such as, wax, polystyrene, plastic, synthetic rubber, or any other substrate as is known in the art. Multiple such patterns may be attached to a common sprue providing an inverted tree like structure of the same volatizable material having one pattern attached to the end of each branch.

After the outer shell has dried around the one or more patterns, the patterns and sprue may be removed by melting, burning or the like, permitting a pattern with undercut portions to be removed from a single piece shell without damage to the surrounding shell. In this pattern removal process, the shell is heated to at least the melting or burning point of the pattern substrate and the pattern substrate is melted or burned away leaving only the shell and any residual substrate. The shell is then heated to a temperature high enough to flash off the residual substrate that remains in the shell.

Once the pattern substrate has been removed from the shell, a hollow central channel with tubular branches leading to cavities corresponding to the one or more patterns will remain. A casting material, for example molten metal, may then be poured down the central channel to pass to the branches into each of the cavities. When a casting material has hardened, the shell material is removed and the cast parts separated from the sprue.

One process of forming the shell used in investment casting involves the repeated steps of dipping the pattern in a liquid slurry, coating the dipped part with refractory material such as stucco, and allowing the slurry and refractory material to harden between dips. Through this repeated process, shells are gradually built up to a thickness of approximately ⅛" or more. It is not uncommon in the industry to use seven or more layers per shell.

Overall, this process of shell building is time consuming because each coat of slurry, each with a corresponding coat of refractory material, must be air-dried prior to the application of subsequent coats. In many cases, shells cannot be baked at elevated temperatures for extended periods of time without compromising the integrity of the cured shell. In these cases, each cycle of dipping and air-drying may require as little as 1 to 2 hours for some patterns or as long as twenty-four to forty-eight hours for other patterns, resulting in a total time to produce a 5-layer shell that may be as short as 5 hours but may typically take several days.

The shell material must be not only sufficiently strong to resist the pressure of the molten cast material but it must also resist deformation, cracking, and/or excessive outgassing when in contact with high-temperature molten casting materials. Desirably the chemicals within the shell should not be overly reactive with the cast material. For example they should not react with the molten metal to produce oxides or scaling that will need to be removed.

The shell's slurry and refractory materials typically forms various chemical bonds as each layer hardens between dips. The type of chemical bonds formed within the investment casting shell depends on the ingredients used to form that shell, and can greatly influence the performance of the shell during casting. Refractory materials such as calcium aluminate cement, colloidal alumina and colloidal silica form hydraulic bonds, as is typical with most known forms of cement, which harden with the addition of water. Other refractory materials, such as sodium silicate and potassium silicate may form silicate bonds. Additionally, additives such as phenolic resin may be added to provide resin bonding while polyvinyl alcohol or carboxymethyl cellulose may be used to provide adhesive bonding in the shell. Once these materials are hardened and the shell is then heated, the refractory materials may also form ceramic bonds through the process of sintering.

However, unlike these prior refractory materials that are used in investment casting, it is desirable to form a refractory material capable of forming a shell for use during investment casting that provides increased structural integrity during casting and improved frangibility during shell removal.

SUMMARY OF THE INVENTION

The present invention provides a refractory material for investment casting that provides good structural integrity during casting and improved frangibility during shell removal and that may be applied in as little as a single layer. These benefits are obtained by using a high viscosity phosphate bonded refractory material. The inventors have recognized that the high temperatures occurring during the curing of phosphate bonded refractory materials, that would prove problematic in investment casting using low temperature pattern materials, can be moderated by proper formulation, for example, by balancing of dibasic and monobasic phosphate and dibasic, monobasic and phosphoric acid proportions. Although the inventors do not wish to be bound by a particular theory, it appears that while the phosphate bonds provide good strength during the investment casting process, high temperatures of casting alternately weakened those bonds after their strength is no longer required greatly enhancing the ability to remove the investment casting material from the cast product. This phosphate bonded refractory material as properly formulated appears to be compatible with the viscosity that allows as little as a single coating of the pattern while accurately reproducing relatively small structures on the pattern.

Specifically, the refractory material may include multiple forms of phosphates, such as a dibasic phosphate and monobasic phosphate that are capable of forming a hardened investment casting shell containing a plurality of phosphate bonds without elevating the temperature during shell hardened to a point that would damage the underlying sacrificial pattern, that may be formed wax or a similar material.

This liquid refractory material may also be a foam that includes gas bubbles suspended in a refractory material substrate and is formulated to react to desired heat exposures without having detrimental effects on existing practices and procedures found within the investment casting industry. That is to say, the refractory foam is capable of direct heat exposure after a 30 minute drying period, and can be exposed to temperatures in excess of 3200 F. Current systems used in the industry require much longer drying periods before being exposed to any type of heat.

It is one feature of at least one embodiment of the invention to provide a method of applying a liquid refractory material to an outer surface of an investment casting wax pattern; curing the liquid refractory material onto the outer surface of the wax pattern to form a shell containing a plurality of phosphate bonds; replacing the wax pattern with a molten material; and allowing the molten material to solidify in the shell to produce the article.

It is one feature of at least one embodiment of the invention that the refractory material contains a dibasic ammonium phosphate and monobasic magnesium phosphate, and is configured to be received on an outer surface of an investment casting wax pattern.

It is one feature of at least one embodiment of the invention that the refractory material containing a plurality of phosphate bonds forms a hardened investment casting shell around an outer surface of a wax pattern.

It is one feature of at least one embodiment of the invention that the refractory material is a foam designed to increase in volume at a controlled rate of growth. This increase in growth may be due to the formation of gas bubbles suspended in the refractory foam by way of an active foaming ingredient.

These particular objects and advantages may apply to only some embodiments falling within the claims and thus do not define the scope of the invention.

DETAILED DESCRIPTION OF THE PREFERRED EMBODIMENTS

I. First Preferred Embodiment

In one embodiment of the current invention the refractory material may be a foam formulation may be as follows in Table 1. While the weight and percent weight of those ingredients identified in the following table may constitute a preferred embodiment, the indicated range in percent weight of each ingredient is also considered within the scope of this invention.

TABLE 1

| Ingredient | Grams | Percent weight | Range in percent weight |
|---|---|---|---|
| Alumina Hydrate | 50.0 | 32.2 | <50 |
| Fritz-Pak Air Plus | 3.0 | 1.9 | <5 |
| Minco 30/50/20 G-2 Formula Ceramic Core Mix | 50.0 | 32.3 | <50 |
| Whiting (CaO) | 2.0 | 1.3 | <5 |
| 85 wt % Phosphoric Acid | 50.0 | 32.3 | <50 |
| Total | 155.0 | 100 | |

A refractory material, according to the general formulation listed in Table 1 is formed by first combining and mixing the solid or dry components, namely the alumina hydrate, Fritz-Pak Air Plus, Minco 30/50/20 G-2 formula ceramic core mix, and CaO whiting. After these dry components are combined, the 85 wt % phosphoric acid liquid is added to the mixture. Once the phosphoric acid is added to the mixture, the active foaming reaction is initiated in the liquid refractory material substrate. Adding of the phosphoric acid creates a reaction between the phosphoric acid and the alumina hydrate generating phosphate bonds in aluminum/phosphate compounds providing strength and hardening to the refractory material. The result of this reaction is the formation of multiple anhydride bonds formed by way of a dehydration reaction, which effectively forces water out of the investment casting shell as it dries. The active foaming process results in the formation of bubbles, i.e., gaseous pockets, suspended within the liquid refractory material substrate. According to the formulation identified in Table 1, the volume of this refractory foam doubles in approximately two minutes. After a working time, i.e., pot life, of approximately two minutes, the mixture will reach its maximum volume and begins to set. Drying into a hardened investment casting shell occurs in approximately 15 minutes and may be accelerated by the use of fans and/or low heat.

An investment casting method employing the refractory foam formulation identified in Table 1 begins with the creation of a pattern, whose outer shape defines the outer shape of a desired casting. The pattern may provide for a wide variety of different cast articles including articles with surface irregularities and undercut portions and is preferably formed from a material readily removed from an investment shell under elevated temperatures. For example the pattern may be formed from wax, polymer foam, paper products, etc. The outer surface of pattern may receive a single coat of refractory foam after the active foaming has been initiated, for example by dipping the pattern into the refractory foam; or alternatively, pouring, brushing or hand packing the foam onto the pattern. The refractory foam coating is then dried to remove water from the foam, resulting in the formation of a single-layer, hardened shell surrounding the pattern. The foam may be passively air dried, or the drying process may be facilitated by some mechanical or thermal means known in the art. Once the hardened shell is formed, the pattern is removed from the shell. In some cases the pattern and shell are exposed to heat sufficient to evacuate the pattern by means of combustion or melting of the pattern. The shell will then be subjected to temperature high enough to flash off any residual pattern material. The evacuation of the pattern will render a hollow shell, having an inner surface complementary to the outer surface of the pattern. The exposure to heat in this step may also result in curing of the hollow shell. Molten metal is then poured into the hollow shell, wherein the metal is allowed to cool and solidify into a casting. In some situations, the pouring of molten metal will occur concurrently with the evacuation of the pattern, requiring that the temperature of the molten metal is sufficiently high to evacuate the pattern. Lastly, the shell is removed from the casting by a means suitable for removing the shell without damaging the casting, such as water exposure, hammering or abrasive blasting for example.

A benefit of this embodiment is that volume expansion, via the active foaming process, allows the refractory foam material to penetrate and fill minute surface irregularities on the underlying pattern. The resultant shell thereby is capable of forming accurate castings of detailed patterns including surface irregularities, undercuts and voids.

Another benefit of this embodiment is the improved green strength of the resultant hardened shell formed from the refractory foam according to the formulation listed in Table 1. The green strength, i.e., the mechanical strength of the shell to resist fracturing, was exhibited at temperatures less than and approximately equal to 2000 degrees Fahrenheit, at which point phosphate bonds began to exhibit some degradation as a result of excess heat. While the entire shell does not fail when exposed to heat at or greater than 2000 degrees Fahrenheit, the shell does exhibit diminished structural integrity and becomes susceptible to crumbling when exposed to the application of modest physical force. Subsequent application of water or submerging of the shell into water allows the shell to readily break down, and may be utilized as a means for removing the shell after casting.

If additional structural integrity at temperatures in excess of approximately 2000 degrees Fahrenheit is necessary, the formulation of Table 1 may be supplemented with an additional 35 grams of a 1400 F frit, such as Ferro Frit 3134. This additional component may be added to the dry mixture before addition of liquid phosphoric acid, and results in the formation of a sintered bond once the shell is exposed to temperature of approximately 1500 degrees Fahrenheit. As such, the sintered bond will provide additional structural integrity despite breakage of phosphate bonds at high temperatures. This formula does not break down in water due to the presence of the sintered bonds, and as such requires hammering or abrasive blasting methods of shell removal after casting.

Another benefit of this embodiment is that the investment casting shell that is formed from refractory foam has a weight of approximately one half of a corresponding traditional shell. As such it much easier for an individual to transport and manipulate such a shell during the casting process. Furthermore, given that the shell includes a substantial volume of entrapped air, the amount of waste product, i.e., refractory martial, in the shell is substantially reduced.

Other variations of the formation listed in Table 1, such as a formulation that utilizes gas forming chemicals or a foam generator other than phosphoric acid, will allow for air entrainment in gaseous pockets within the refractory material substrate and are considered within the scope of this invention.

II. Second Preferred Embodiment

In an alternative embodiment of the current invention the refractory material formation may include phosphates as follows in Table 2. While the weight and percent weight of those ingredients identified in the following table may constitute a preferred embodiment, the indicated range in percent weight of each ingredient is also considered within the scope of this invention.

TABLE 2

| Ingredient | Grams | Percent weight | Range in percent weight |
|---|---|---|---|
| 85 wt % Phosphoric Acid | 4.2 | 3.7 | <15 |
| Monobasic Ammonium Phosphate | 0.7 | 0.6 | <2 |
| Dibasic Ammonium Phosphate | 0.8 | 0.7 | <2 |
| 30 wt % Collodial Silica | 4.3 | 3.8 | <15 |
| Surfactant | 1.5 | 1.3 | <5 |
| Refcon | 15.0 | 13.3 | <50 |
| Alumina Hydrate | 3.0 | 2.7 | <10 |
| Small Alumina | 10.0 | 8.9 | <30 |

TABLE 2-continued

| Ingredient | Grams | Percent weight | Range in percent weight |
|---|---|---|---|
| Bubbles, 0.2 mm diameter | | | |
| Large Alumina Bubbles 0.5 mm diameter | 10.0 | 8.9 | <30 |
| Latex | 1.5 | 1.3 | <5 |
| Ransom and Randolph 50/50 ceramic core mix | 40.0 | 35.5 | <75 |
| $H_2O$ | 21.8 | 19.3 | <50 |
| Total | 112.8 | 100.0 | |

As opposed to the chemical reaction that resulted in the formation of volume expanding active foaming in the first preferred embodiment, the second preferred embodiment includes a refractory material, i.e., foam, having a preformed bubble or gaseous pocket structure. That is to say the foam structure of the refractory material of the second preferred embodiment is not a result of mixing the active foaming ingredients, but rather includes preformed bubbles, i.e., gaseous pockets, that are added to the refractory material substrate as an ingredient. In one embodiment, the preformed bubbles are alumina bubbles, i.e., gaseous volumes surrounded by a thin alumina outer surface; however, bubbles formed of other materials suitable for use in the refractory arts are considered within the scope of this invention.

By means of directly adding the preformed bubbles in to the refractory material substrate it is possible to more precisely control the structural integrity, or ratio of refractory material to entrapped gas, of the resultant foam mixture, as compared to the active formation of bubbles when utilizing gas generation ingredient(s), as was described above As specified in the preferred embodiment included in Table 2 above, the alumina bubbles account for approximately 18% of the refractory foam by weight, including approximately 9% of both 0.2 mm and 0.5 mm diameter bubbles. Altering the size of the bubbles, which may vary from 0.2 to 3 mm in diameter, in turn alters the volume of air trapped within the foam, and thereby alters the strength of the ceramic casting shell. For example, a foam formed of solely 0.2 mm alumina bubbles exhibits the greatest modulus of rupture strength, which decreases with the addition of larger diameter bubbles. The alumina bubbles may comprise as much as 60% of the total weight of the refractory foam.

Alumina was selected for forming the bubbles of this embodiment because it is both inert and has a particularly high melting point of approximately 3762 degrees Fahrenheit. The high melting point of alumina results in a cured casting shell that remains frangible, and can be more easily removed after casting. While the alumina bubbles were included in the formulation of this second embodiment, other formulations (not necessarily using bubbles of alumina) are considered well within the scope of this invention.

In addition the presence of alumina bubbles, this embodiment provides for a hardened investment casting shell containing phosphate bonds due to the presence of both a monobasic and dibasic phosphate. This embodiment particularly includes monobasic and dibasic ammonium phosphates, but any other form of phosphates may be used including but not limited to magnesium phosphate. The presence of both monobasic and dibasic phosphate provides for a controlled exothermic phosphate bonding that does not exceed the melting point of wax. As such, the phosphate bonding does not damage or warp the underlying wax pattern during the hardening of the investment casting shell. Furthermore, at high temperatures the phosphate bonding becomes weakened, such that the shell exhibits increased frangibility during removal after casting. This is particularly beneficial for the removal of core shells, i.e., casting shells used to form interior voids in a cast article, which may be otherwise difficult to access.

Furthermore, this embodiment may also include a thickening agent and a wetting agent, i.e., a surfactant. The thickening agent, for example starch or modified corn starch, may alter the structural integrity of the refractory foam as it relates to the percentage of thickening agent present in the formulation. Alternatively, a 1:1 ratio of a citric acid powder to Kelco-Crete may provide the similar thickening benefits seen with modified corn starch. Furthermore, a lesser amount of starch, which burns off during the heating process, adds rigidity to the refractory foam casting shell, whereas a greater amount of starch weakens the casting shell. Therefore, by alerting the percentage of thickening agent present in the formation it is possible to alter the frangibility of the casting shell, which is critical during the shell removal stage.

Also indicated in the chart above is a 50/50 ceramic core mixture produced by Ransom & Randolph. However, alternative ceramic core mixtures may be considered within the scope of this invention and receive the thickening agent, wetting agent and preformed bubbles therein.

Formation of an investment casting shell, and method of investment casting utilizing a refractory foam with preformed bubbles, such as is listed in Table 2, is identical to the method described above in the first preferred embodiment. Generally, a single coating of the refractory foam is placed on the outer surface of a pattern. The refractory foam coating is then dried to remove water from the foam, resulting in the formation of a single-layer, hardened shell surrounding the pattern. Once the hardened shell is formed, the pattern is removed from the shell, for example by heat evacuation and flashing off residual material. Molten metal is then poured into the resultant hollow shell, wherein the metal is allowed to cool and solidify into a casting. Lastly, the shell is removed from the casting by a means suitable for removing the shell without damaging casting, such as through water exposure, hammering or abrasive blasting for example.

III. Third Preferred Embodiment

In another alternative embodiment of the current invention the refractory material formation may be as follows in Table 3. While the weight and percent weight of those ingredients identified in the following table may constitute a preferred embodiment, the indicated range in percent weight of each ingredient is also considered within the scope of this invention.

TABLE 3

| General Ingredient and Preferred Ingredient | Percent weight | Range in percent weight |
|---|---|---|
| Dead burn Magnesium Oxide (MgO), and preferably pulverized MagChem P-98 | 33.9 (MagChem P-98) | <60 |
| Phosphate component, including dibasic ammonium phosphate and/or mono magnesium phosphate, and preferably pulverized dibasic ammonium phosphate and mono magnesium phosphate | 1.7 (Dibasic ammonium phosphate)<br>7.6 (Mono magnesium phosphate) | <5 |
| Refractory aggregates including any or all of the following: alumina bubbles, alumina spheres, tabular alumina, fused alumina, molecular sieves, natural zeolites, fused silica, and/or silicates of mesh sizes varying from 120 to 8, and preferably 120 mesh tabular alumina | 32.2 (120 mesh tabular alumina) | <60 |
| Refractory flour including alumina and/or zircon, and preferably 325 mesh Zircon | 8.5 (325 mesh Zircon) | <25 |
| Viscosity increasing gum, preferably Kelco-crete | 0.40 (Kelco-crete) | <5 |
| Wetting agent either liquid or dry, and preferably Buntrock PS-9400 | 0.40 (Buntrock PS-9400) | <5 |
| Water | 15.3 (Tap water) | <40 |
| Total | 100 | |

As with prior embodiments, a refractory material, according to the general formulation listed in Table 3 is formed by first combining and mixing the solid or dry components, namely the dead burn magnesium oxide, the phosphate component, the refractory aggregates, refractory flour, viscosity increasing gum and a dry wetting agent when applicable. When applicable, the water and liquid wetting agent are independently combined. The independently combined mixtures of dry and liquid components are then combined and thoroughly stirred together. According to the formulation identified in Table 3, the volume of this refractory liquid has a working time of approximately two to three minutes before it begins to set. The refractory liquid cures into a hardened investment casting shell in approximately fifteen minutes and may be accelerated by the use of fans and/or low heat.

This refractory liquid formulation listed in Table 3 provides for a hardened investment casting shell containing phosphate bonds due to the presence of both a monobasic magnesium phosphate and dibasic ammonium phosphate. The presence of these phosphates and their relative range in percent weight phosphate provides for a controlled exothermic phosphate bonding that does not exceed the melting point of wax. As such, the phosphate bonding does not damage or warp the underlying wax pattern during the hardening of the investment casting shell.

As was described in the previous embodiment, directly adding the alumina bubbles to the refractory liquid, i.e., material substrate, results in forming a foam that provides increased control over the structural integrity of the resultant foam mixture, as compared to the formation of bubbles when including gas generation ingredient(s) into the refractory foam mixture. As such, alumina bubbles or alternatively an active foaming agent may be optionally added to the general formulation for the refractory liquid listed in Table 3, to form refractory foam.

The refractory material, according to the general formulation listed in Table 3, in either liquid or foam, is suitable for use in forming investment casting shells that include voids in the pattern, i.e., cores within the casting shell, which are traditionally difficult to both cast and remove after casting. That is to say that the refractory liquid can be cast into a mold, such as a rubber mold, that has the desired shape of a core and allowed to harden. This hardened core may then be incorporated into a wax pattern as the wax pattern is made, and subsequently coated with refractory liquid to form a shell including a separately formed and fully integrated core.

Furthermore, this refractory liquid may be used for casting metals of both relatively high melting points, such as steel, and relatively low melting points, such as aluminum. The methods for casting such metals is identical to the method of forming an investment shell and casting a metal as was described above in preferred embodiment two.

An additional benefit of this embodiment is that at high temperatures the phosphate bonding becomes weakened, such that the shell exhibits increased frangibility during removal after casting. As such, high pressure water will be able to remove the hardened investment casting shell material after it has been poured with molten metal. As opposed to hammering or the use of abrasives, this quick and relatively low impact removal method prevents damage to the underlying metal casting. This is due in part to the desirable degradation of the refractory material's phosphate bonds when exposed to increased temperatures, and optional foam structure, which in turn makes the shell easy to remove after casting.

Another benefit of the refractory material, according to the general formulation listed in Table 3 is that is can be applied directly to a casting pattern, and does not deform the surface of the pattern as the liquid refractory hardens and cures into a shell. Alternatively, other refractory materials may emit excess heat during the exothermic curing process that can melt or otherwise deform the outer surface of the underlying wax pattern. As previously stated, the combination of monobasic and dibasic phosphates in this refractory material does not emit detrimental heat during the material's curing process.

In those situations when it is desirable to combine the refractory material with traditional casting techniques, i.e., dipping a pattern into a liquid slurry and coating the liquid coat in a dry refractory material, the present invention demonstrates strong interfacing qualities with these foundry casting materials. That is to say the refractory material of the current invention bonds well to traditional investment casting shell materials.

During the casting process, the hardened shell formed from the refractory material may be subjected to autoclaving or flash firing to remove the inner pattern, without exploding or cracking. This result is significant given the amount of entrapped air and water that may be contained within the refractory foam shell.

IV. Fourth Preferred Embodiment

In another alternative embodiment of the current invention the refractory material formation may be as follows in Table 4. While the weight and percent weight of those ingredients identified in the following table may constitute a preferred embodiment, the percent weight of each ingredient is considered an approximation and variations thereof are also considered within the scope of this invention.

TABLE 4

| General Ingredient and Preferred Ingredient | Percent weight |
|---|---|
| Dead burn Magnesium Oxide (MgO), and preferably pulverized MagChem P-98 | 5.0 |
| Ref-Bond Mono Magnesium Phosphate | 6.0 |
| Brown Fused Alumina, and preferably 80-100 mesh | 55.0 |
| Tabular Alumina Flour, and preferably 325 mesh | 32.5 |
| Corn Starch, | 0.3 |
| Citric Acid Powder | 0.2 |
| Wetting Agent, and preferably Buntrock PS-9400 | 0.5 |
| Total | 100 |

A refractory material, according to the general formulation listed in Table 4 is formed by first combining the Buntrock PS-9400 wetting agent with 18% water by weight to form a pre-mixed liquid portion. The solid or dry components, namely the dead burn magnesium oxide, Ref-Bond Mono Magnesium Phosphate, Brown Fused Alumina, Tabular Alumina Hour, corn starch and citric acid powder are then mixed into the premixed liquid portion. According to the formulation identified in Table 4, the volume of this refractory liquid has a pot life or working time of approximately two to three minutes before it begins to set. The refractory liquid cures into a hardened investment casting shell in approximately fifteen minutes and may be accelerated by the use of fans and/or low heat.

Although the invention is described with reference to an illustrated embodiment, it should be appreciated by those of ordinary skill in the art that various modifications are well within the scope of the invention. Therefore, the scope of the invention is to be determined by reference to the following claims:

What we claim is:

1. A liquid investment casting refractory material for lost wax casting of high-temperature molten materials comprising:

a liquid refractory material containing a fused silica, a dead burned magnesium oxide, a surfactant, an acid powder and a monobasic magnesium phosphate, in an amount providing a flowable state such that the liquid refractory material will flow about an outer surface of an investment casting wax pattern;

wherein the liquid refractory material as configured hardens for use as a shell having a plurality of phosphate bonds at an ambient temperature lower than a melting point of the investment casting wax pattern, the shell comprising a cavity having an inner surface complementary to an outer surface of the investment casting wax pattern for receiving casting of a high-temperature molten material, having a temperature of greater than 1500° F., therein.

2. The liquid investment casting refractory material of claim 1, wherein the liquid refractory material contains greater than 5% by weight of the monobasic magnesium phosphate.

3. The liquid investment casting refractory material of claim 2, wherein the liquid refractory material contains greater than 1% by weight of a dibasic ammonium phosphate and greater than 7% by weight of the monobasic magnesium phosphate.

4. The liquid investment casting refractory material of claim 3, wherein the liquid refractory material contains greater than 10% by weight of the monobasic magnesium phosphate.

5. The liquid investment casting refractory material of claim 1, wherein the liquid refractory material is a foam having gaseous pockets suspended in a refractory material substrate.

6. The liquid investment casting refractory material of claim 5, wherein the liquid refractory material comprises less than 60% by weight of an entrapped gas.

7. The liquid investment casting refractory material of claim 1, wherein the liquid refractory material contains approximately 5% by weight of the dead burned magnesium oxide.

8. The liquid investment casting refractory material of claim 7, wherein the dead burned magnesium oxide is a pulverized dead burned magnesium oxide.

9. The liquid investment casting refractory material of claim 1, wherein the liquid refractory material contains at least 60% by weight of the fused silica.

10. The liquid investment casting refractory material of claim 9, wherein the fused silica comprises a first fused silica portion and a second fused silica portion, and wherein the first fused silica portion has average particle size of between 80 and 100 mesh.

11. The liquid investment casting refractory material of claim 10, wherein an average particle size of the second fused silica portion is smaller than the average particle size of the first fused silica portion.

12. The liquid investment casting refractory material of claim 1, wherein the liquid refractory material contains less than 5% by weight of the surfactant.

13. The liquid investment casting refractory material of claim 1, wherein the liquid refractory material contains at least 0.2% by weight of the acid powder.

14. The liquid investment casting refractory material of claim 13, wherein the acid powder comprises a first acid powder component and a second acid powder component, and wherein the first acid powder component is citric acid powder.

15. The liquid investment casting refractory material of claim 1, wherein the liquid refractory material further comprises cornstarch.

16. A pre-casting system for use with lost mold casting of high-temperature molten materials comprising:

an amount of a liquid refractory material containing a fused silica, a dead burned magnesium oxide, a surfactant, an acid powder and a monobasic magnesium phosphate, providing a flowable state such that the liquid refractory material will flow about an outer surface of an investment casting pattern;

wherein the liquid refractory material as configured hardens for use as a shell having a plurality of phosphate bonds at an ambient temperature lower than a melting point of the investment casting pattern, the shell comprising a cavity having an inner surface complementary to an outer surface of the investment casting wax pattern for receiving casting of a high-temperature molten material, having a temperature of greater than 1500° F., therein.

17. The liquid investment casting refractory material of claim 16, wherein the liquid refractory material contains approximately 5% by weight of the dead burned magnesium oxide.

18. The liquid investment casting refractory material of claim 16, wherein the liquid refractory material contains at least 60% by weight of the fused silica.

19. The liquid investment casting refractory material of claim 16, wherein the liquid refractory material contains less than 5% by weight of the surfactant.

20. A pre-casting system for use with lost mold casting of high-temperature molten materials comprising:

a liquid refractory material containing at least 60% by weight of a fused silica, approximately 5% by weight of a dead burned magnesium oxide, a surfactant, an acid and at least 5% by weight of a monobasic magnesium phosphate, in an amount providing a flowable state such that the liquid refractory material will flow about an outer surface of an investment casting wax pattern;

wherein the liquid refractory material as configured hardens for use as a shell having a plurality of phosphate bonds at an ambient temperature lower than a melting point of the investment casting wax pattern, the shell comprising a cavity having an inner surface complementary to an outer surface of the investment casting wax pattern for receiving casting of a high-temperature molten material, having a temperature of greater than 1500° F., therein.

* * * * *